United States Patent [19]

Walser et al.

[11] 4,222,421

[45] Sep. 16, 1980

[54] PRESSURE BAR FOR VENEER CUTTING

[75] Inventors: Donald C. Walser, Surrey; Thomas A. McLauchlan, Vancouver, both of Canada

[73] Assignee: Canadian Patents & Development Ltd., Ottawa, Canada

[21] Appl. No.: 919,464

[22] Filed: Jun. 27, 1978

[51] Int. Cl.[3] ..... B27C 7/00

[52] U.S. Cl. ..... 144/325; 144/213; 83/170

[58] Field of Search ..... 144/209 R, 211, 212, 144/213, 178, 323, 325; 83/170, 915 S

[56] References Cited

U.S. PATENT DOCUMENTS

| | | | |
|---|---|---|---|
| 1,804,704 | 5/1931 | Osgood | 144/213 |
| 1,989,386 | 1/1935 | Tallquist et al. | 144/213 |
| 3,265,103 | 8/1966 | Hervey | 144/212 |
| 3,581,844 | 6/1971 | Carlton | 144/213 |
| 3,584,666 | 6/1971 | Jensen | 144/213 |

FOREIGN PATENT DOCUMENTS

| | | | |
|---|---|---|---|
| 140744 | 4/1903 | Austria | 144/212 |
| 1214385 | 4/1966 | Fed. Rep. of Germany | 144/212 |
| 435934 | 1/1973 | U.S.S.R. | 144/213 |

*Primary Examiner*—W. Donald Bray
*Attorney, Agent, or Firm*—Ronald G. Bitner

[57] ABSTRACT

A pressure bar of the fixed type for veneer cutting is heated to reduce frictional drag against the wood surface. In the preferred form, the pressure bar is contoured having a tip with a relatively small radius of curvature and a face, in advance of the tip, which has a relatively large radius of curvature. The combination of a heated contoured pressure bar provides performance comparable with that of a roller bar in terms of roughness and friction, but at significantly reduced cost.

1 Claim, 2 Drawing Figures

PRESSURE BAR FOR VENEER CUTTING

BACKGROUND OF THE INVENTION

This invention relates to the cutting of veneer, and particularly to an improved pressure bar for a veneer cutting apparatus.

In the production of veneer, which can be by rotary peeling of a bolt or by slicing from a flitch, it is common practice to use a pressure bar, or nose bar, which is pressed against the wood surface near the point of contact of the veneer cutting blade to prevent uncontrolled splitting ahead of the cutting edge and to limit the depth of tension checks formed by the wedging action of the blade tip. Pressure bars in use are either the roller or fixed type.

The fixed pressure bar is considerably simpler, requiring less maintenance and is less expensive than a roller pressure bar. However, conventional fixed pressure bars are not entirely satisfactory for the peeling of softwoods. Fixed pressure bars impose relatively high drag due to friction between the bar face and wood surface. High frictional drag means more torque is required for turning the bolt, making it more difficult to peel close to wood defects, such as ring shakes and splits, without having the bolt break. Frictional drag also increases the tendency for lathe chucks to spin out. Conventional fixed pressure bars also tend to dislodge slivers from softwood, and these slivers and other debris accumulate along the length of the bar. This accumulation leads to overcompression and the production of scored and/or rough, furry veneer. To avoid these difficulties, veneer lathes for cutting softwoods are fitted with the more expensive roller pressure bars.

SUMMARY OF THE INVENTION

It has been found that the frictional drag of a fixed pressure bar can be significantly reduced by heating the wood contacting surface of the pressure bar.

It was further found that further improvements are obtained if the pressure bar has a contoured tip and face rather than a sharp tip and flat face as in conventional fixed bars. The combination of a pressure bar that is heated and contoured, in addition to reducing frictional drag, reduces surface roughness providing the advantages of a roller bar but at considerably reduced cost.

In accordance with one aspect of the present invention, the frictional drag of a fixed pressure bar is reduced by heating the wood contacting surface of the pressure bar. Preferably the wood contacting surface of the pressure bar is heated to a temperature of from 70° to 250° C.

In accordance with another aspect of the invention, the pressure bar is contoured with a tip portion having a small radius portion and a face portion having a relatively larger radius of curvature. Preferably, the tip portion will have a radius of curvature of from 0.005 to 0.4 inches, and the face portion a radius of from 1 to 6 inches.

DESCRIPTION OF PREFERRED EMBODIMENTS

Figure 1:
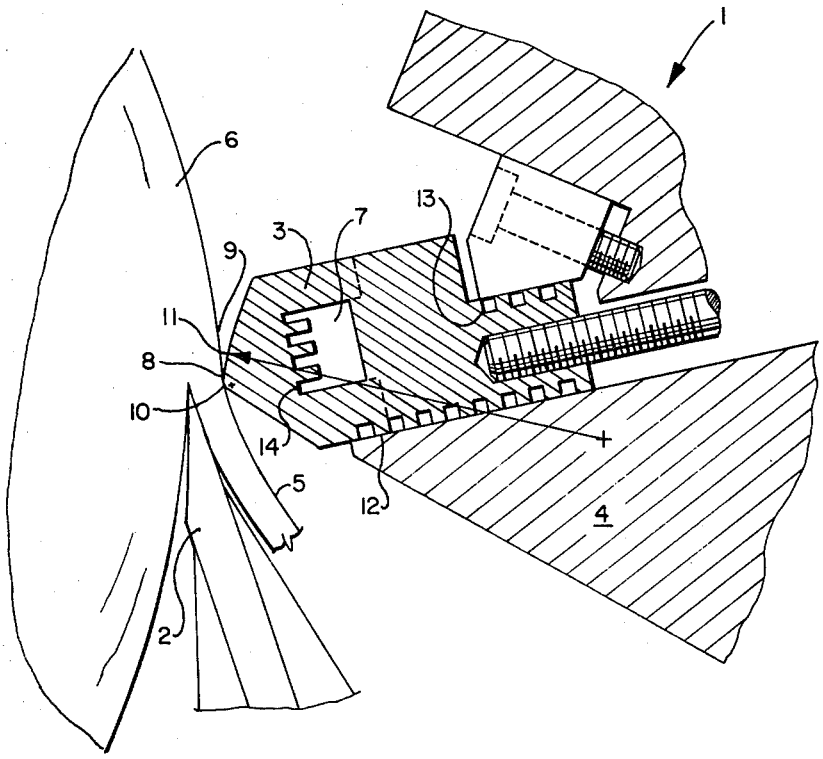
FIG. 1 is a cross-sectional view of a veneer lathe incorporating a pressure bar in accordance with the present invention.

FIG. 1 shows a portion of a veneer lathe 1 having a knife 2 and a pressure bar 3 in accordance with the present invention mounted on a carriage 4. Veneer 5 is shown being cut from a bolt 6.

The pressure bar 3 is provided with a passageway 7 for conducting a heating fluid such as steam. The heating fluid heats the wood contacting surface 8 of the bar which reduces the friction of the bar with respect to the surface 9 of bolt 6 as the veneer 5 is being cut.

Although the reason for friction reduction is not understood with certainty, it is believed that the effect may be due, at least in part, to thermal softening of the wood surface by the heated surface of the bar.

Improvements are achieved as the temperature of the wood contacting surface is raised above ambient temperatures. The preferred range is from 70° to 250° C. The most significant improvements were obtained at temperatures of from 150° to 200° C. As temperatures are increased further frictional drag increases and degradation of the wood results. The reduction of friction obtained by heating means that less torque is required to turn the bolt and reduces bolt breakage and the tendency of the lathe chucks to spin-out.

The wood contacting surface 8 of the bar 3 is contoured with a tip portion 10 having a small radius of curvature, and a face portion 11, in advance of the tip 10, having a relatively large radius of curvature. The face portion 11 in advance of the tip 10 allows slivers to be swept past the pressure bar which in conventional fixed bars tend to accumulate at the tip and results in a rough veneer surface.

Preferably, the wood contacting surface of the pressure bar will be provided with hard wearing material such as chrome plating.

The radius of curvature of the tip 10 should preferably be less than 0.4 inches. Optimum results were obtained with a radius of about 0.03 inches. To facilitate maintaining a chrome plated surface, the radius should be greater than 0.005 inches.

The radius of curvature of the face portion 11 should preferably be in the range of 1 to 6 inches. A radius greater than 6 inches presents an excessively high face area in contact with the wood surface and an increase in frictional drag. Optimum results were obtained with a radius of 2.5 inches.

The surfaces 12 and 13 of the pressure bar 3 which are in contact with the carriage 4 are provided with grooves to reduce the contact area and thus heat transfer to the carriage which may be sensitive to thermal expansion.

The passageway 7 of the pressure bar 3 is provided with grooves 14 to increase heat transfer to the wood contacting surface 8.

It will be understood that the pressure bar of the present invention may be heated by means other than a heated fluid such as steam or oil, for example by electric heating.

Figure 2:
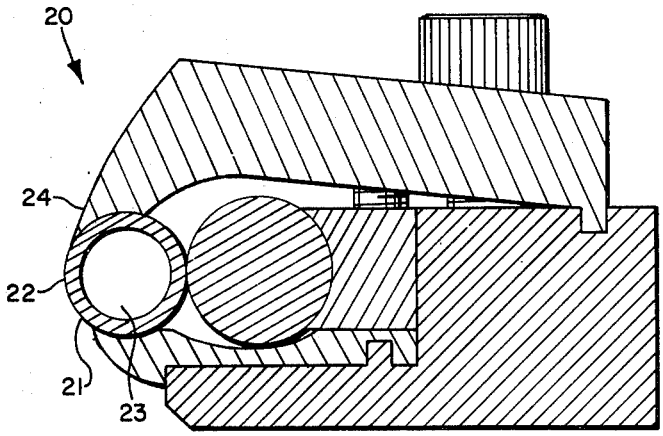
FIG. 2 is a cross-sectional view of another embodiment wherein a standard roller pressure bar is modified in accordance with the present invention.

FIG. 2 shows an alternate embodiment of the invention, in the form of a modified roller bar 20. The bolt contacting roller of a conventional roller bar is replaced by a tubular element 21 that is fixed. As in the embodiment of FIG. 1, the wood contacting tip 22 is heated by passing steam through the passageway 23 of the tubular element 21. The upper lip 24 is modified to define the face portion. In combination, the tip 22 of tubular element 21 and the lip 24 provide a contoured surface with compound curvature similar to the embodiment of FIG. 1. The tubular element may be rotated periodically to provide a new contacting surface for the tip 22.

EXAMPLE 1

Tests were conducted to determine the effects of temperature on wood-to-steel friction. The tests were conducted on western hemlock and spruce, two of the most common softwood species used by industry in Western Canada. The table below shows the effect of different temperatures on the friction coefficient between a tangential surface of green wood and a chrome-plated steel surface.

| Temp. of chrome-plated steel surface °C. | Friction coefficient | |
|---|---|---|
| | Hemlock | Spruce |
| 20 | 0.492 | 0.512 |
| 90 | 0.228 | 0.244 |
| 110 | 0.235 | 0.217 |
| 150 | 0.204 | 0.210 |
| 200 | 0.220 | 0.201 |
| 250 | 0.276 | 0.259 |
| 300 | 0.294 | 0.278 |

The results indicate that as the temperature of the steel surface rose from 20° C. to 90° C., friction decreased by more than 50% for both wood species. Maximum friction reduction occurred between 150° and 200° C.

EXAMPLE 2

An experimental pressure bar was constructed for a 66 inch laboratory veneer lathe. The pressure bar was provided with a passageway for steam similar to that shown in FIG. 1.

Tests were conducted to compare veneer quality, particularly surface roughness, using four different types of pressure bar types, namely: a conventional type roller pressure bar, a contoured fixed bar without heating; a contoured fixed bar with heating with steam at about 150° C.; and a contoured fixed bar with heating at about 150° C. and having orifices that allowed steam to impinge on the bolt surface. The latter two were provided by using interchangeable caps for the pressure bar, one without orifices.

Ten western white spruce bolts were peeled with each type of bar. Veneer thickness was set at 1/10-inch and cutting speed maintained at 150 feet per minute. Lathe settings were held constant, with the exception that the roller pressure bar required a larger vertical gap. Operating temperature for the heated pressure bar was 150° C.

Veneer samples were selected from the sapwood, heartwood and corewood areas of each bolt and measured for surface roughness, thickness, and lathe-check depth.

Veneer surface roughness was found to be the critical factor for selecting the pressure bar which yielded the best veneer quality. Thickness and lathe-check depth were not greatly affected by bar design.

A roughness depth of 0.020-inch was considered as the maximum depth for acceptable veneer. In the test, all veneers with roughness deeper than this limit were considered degrade and recorded as a percentage of the total veneer produced.

Of the four pressure bar types, the roller bar produced the poorest quality veneer. Average roughness depth was 17.5 thousandth inch and 20.7% of this veneer was beyond the 0.020-inch roughness tolerance limit.

The contoured pressure bar without heat produced significantly better veneer quality, with an average roughness depth of 14.3 thousandths inch and only 4.1% of the veneer beyond the limit.

The best veneer quality for the study was produced by the two heated pressure bars. The contoured steam-heated bar produced a roughness depth of 12.5 thousandths inch, with only 1.4% of the veneer outside the tolerance. Veneer from the contoured steam-injection bar was slightly rougher, with 12.7 thousandths inch depth and 3% off tolerance.

All three of the contoured pressure bars gave better results than the standard roller bar. No problems with sliver buildup or veneer scoring were observed with any of the contoured pressure bars.

EXAMPLE 3

A pressure bar similar to that shown in FIG. 1 was installed in an industrial Premier lathe. The pressure bar had a tip radius of 1/32 inches and a face radius of 2.5 inches. The tip defining member and face were plated with chrome. Steam was applied at various temperatures between 115° and 177° C. Testing involved a variety of softwood species found in Western Canada. The best results were obtained between 155° to 165° C. Operation at these temperatures produced results similar to that of a conventional roller bar, that is, there appeared to be no quality difference in roughness or lathe check depth, and no increase in spinouts or decrease in yield.

We claim:

1. In a system for cutting veneer using a fixed pressure bar, the improvement comprising heating the wood contacting surface of the pressure bar to a temperature of from 70° to 250° C. to reduce the frictional drag on the wood.

* * * * *

UNITED STATES PATENT AND TRADEMARK OFFICE

CERTIFICATE OF CORRECTION

PATENT NO. : 4,222,421

DATED : September 16, 1980

INVENTOR(S) : Donald C. Walser & Thomas A. McLauchlan

It is certified that error appears in the above-identified patent and that said Letters Patent are hereby corrected as shown below:

Claim 1 should read as follows:

1. In a process for cutting veneer wherein a wood contacting surface of a fixed pressure bar is pressed against wood in proximity to a cutting knife as it cuts the veneer, the improvement comprising heating the wood contacting surface of the pressure bar to a temperature of from 70 to 250°C to reduce the frictional drag on the wood.

Signed and Sealed this

*Thirtieth* Day of *December 1980*

[SEAL]

*Attest:*

SIDNEY A. DIAMOND

*Attesting Officer*

*Commissioner of Patents and Trademarks*